US006158840A

United States Patent [19]

Kobayashi et al.

[11] Patent Number: 6,158,840

[45] Date of Patent: Dec. 12, 2000

[54] INK JET RECORDING APPARATUS

[75] Inventors: Atsushi Kobayashi; Kazuhiko Hara; Koichi Toba, all of Nagano, Japan

[73] Assignee: Seiko Epson Corporation, Tokyo, Japan

[21] Appl. No.: 09/045,939

[22] Filed: Mar. 23, 1998

[30] Foreign Application Priority Data

| | | | |
|---|---|---|---|
| Mar. 25, 1997 | [JP] | Japan | 9-090133 |
| Mar. 26, 1997 | [JP] | Japan | 9-091559 |
| Feb. 24, 1998 | [JP] | Japan | 10-058889 |
| Mar. 3, 1998 | [JP] | Japan | 10-067937 |

[51] Int. Cl.[7] ..... B41J 21/165

[52] U.S. Cl. ..... 347/33; 347/29; 347/36

[58] Field of Search ..... 347/33, 36, 35, 347/32, 29

[56] References Cited

U.S. PATENT DOCUMENTS

| | | | |
|---|---|---|---|
| 5,065,158 | 11/1991 | Nojima et al. | 347/33 |
| 5,155,497 | 10/1992 | Martin et al. | 347/33 |
| 5,555,461 | 9/1996 | Ackerman | 347/33 |
| 5,606,354 | 2/1997 | Bekki et al. | 347/33 |
| 5,798,775 | 8/1998 | Takahashi | 347/33 |
| 5,896,143 | 4/1999 | Matsui et al. | 347/33 |

FOREIGN PATENT DOCUMENTS

| | | |
|---|---|---|
| 0 449 324 | 10/1991 | European Pat. Off. . |
| 0 513 833 A2 | 11/1992 | European Pat. Off. . |
| 0 709 204 A1 | 5/1996 | European Pat. Off. . |
| 8-1955 | 1/1996 | Japan . |

OTHER PUBLICATIONS

Patent Abstracts of Japan, vol. 011, No. 321 (M–633), Oct. 20, 1987.

Patent Abstracts of Japan, vol. 011, No. 318 (M–632), Oct. 16, 1987.

Patent Abstracts of Japan, vol. 016, No. 051 (M–1209) Feb. 10, 1992.

Patent Abstracts of Japan, vol. 012, No. 126 (M–687), Apr. 19, 1988.

Patent Abstracts of Japan, vol. 016, No. 321 (M–1279), Jul. 14, 1992.

*Primary Examiner*—N. Le

*Assistant Examiner*—Shihwen Hsieh

*Attorney, Agent, or Firm*—Sughrue, Mion, Zinn, Macpeak & Seas, PLLC

[57] ABSTRACT

A cleaning blade which comes in elastic contact with a nozzle plate to clean a recording head is subjected to ink-receptive treatment on the surface thereof which comes in contact with the nozzle plate, such as formation of grooves or the like which can retain an ink by a capillary force. In this arrangement, an ink can be retained on the blade regardless of the rebounding of the blade shortly after the termination of cleaning operation, making it possible to prevent the ink from flying toward the recording head when the blade rebounds.

16 Claims, 6 Drawing Sheets

FIG. 5 III

INK JET RECORDING APPARATUS

BACKGROUND OF THE INVENTION

1. Field of the Invention

The present invention relates to a recording apparatus provided with a recording head for expelling ink droplets and particularly to a cleaning device for recording head.

2. Related Art

The main body of an ink jet recording head has an extremely small size and is capable of color printing if inks having different colors are used. Accordingly, an ink jet color printer has been put into practical use which includes a carriage provided with a black recording head for expelling a black ink and a color recording head for expelling yellow, cyan and magenta inks to enable text printing with a black ink as well as full-color printing.

Such an ink jet recording head is disadvantageous in that since an ink pressed in a pressure-producing chamber is jetted onto a recording paper in the form of ink droplet from a nozzle opening, the ink exhibits a raised viscosity or solidifies due to the evaporation of ink solvent or attracts dust or paper dust to cause malprinting.

In order to overcome these disadvantages, an ink jet recording apparatus normally includes a capping means for sealing the nozzle opening in the recording head while printing is not effected to prevent ink drying as well as a cleaning means which comes in sliding contact with the nozzle plate to give physical resolution to clogging in the nozzle opening.

Such a cleaning means is in the form of a blade formed by a plate made of an elastic material such as rubber. The cleaning mechanism is arranged such that when the carriage moves the recording head back and forth with the cleaning means protruding to a position at which it can come in elastic contact with the nozzle plate of the recording head, the tip of the blade can scratch dust and ink dregs off the nozzle plate with the ink.

Since the cleaning blade is brought into contact with the side of the recording head shortly before it comes in elastic contact with the nozzle plate of the recording head so that the ink containing paper dust or solid content is wiped off the cleaning blade, it can stay clean itself when applied to a cleaning operation for the nozzle plate of the recording head. However, this cleaning mechanism is disadvantageous in that when the cleaning blade leaves the recording head shortly after the termination of the cleaning operation to release the elastic force, it springs back to cause the ink wiped to fly in the form of droplets that stain the adjacent recording head and the interior of the housing.

Another disadvantage is that the prolonged use of the recording head causes the ink to solidify and accumulate on the side thereof. The ink thus accumulated moves to the cleaning blade from which it then stains the recording head, impairing the effect of the cleaning blade of cleaning the nozzle plate. In order to overcome this difficulty, a cleaning mechanism is proposed comprising another cleaning member provided in a non-printing zone for scratching ink, dust and ink dregs off the cleaning blade whereby the carriage is allowed to move to the cleaning member prior to the beginning of cleaning operation where the ink is scratched off the cleaning blade, and then allowed to move back to the original position where cleaning operation then begins. However, this cleaning mechanism is disadvantageous in that since the carriage needs to perform an extra movement to remove the ink from the cleaning blade, it adds to the entire cleaning time.

SUMMARY OF THE INVENTION

The present invention concerns an ink jet recording apparatus comprising a recording head which jets ink droplets from an opening in a nozzle plate in response to a printing signal, a carriage having said recording head mounted thereon which performs a scanning movement relative to a recording medium and a cleaning blade which comes in elastic contact with said nozzle plate, provided in that said cleaning blade has been subjected to ink-receptive treatment on at least the surface thereof which comes in contact with said nozzle plate. In this arrangement, the ink can be retained on the cleaning blade regardless of the rebound of the cleaning blade.

Accordingly, the ink wiped off the nozzle plate can be prevented from flying from the cleaning blade, inhibiting stain on the housing or the adjacent recording head.

It is therefore a first object of the present invention to provide an ink jet recording apparatus in which it is unlikely that ink droplets will be produced due to the rebounding of the cleaning blade shortly after the termination of cleaning operation.

The present invention also concerns an ink jet printing apparatus comprising a recording head which jets ink droplets from an opening in a nozzle plate in response to a printing signal, a carriage having said recording head mounted thereon which performs a scanning movement relative to a recording medium and a cleaning blade which comes in elastic contact with said nozzle plate, characterized in that a wall portion is formed opposed to said recording head along the direction of scanning movement of said recording head in the vicinity of said recording head with a predetermined gap therefrom on the cleaning initiation side of said recording head and an ink-absorbing material is provided in a zone opposed to the tip of said wall portion during the capping of said recording head with said capping means. In this arrangement, the ink can be scratched off the cleaning blade by the wall portion while the recording head is being cleaned. Accordingly, the nozzle plate can be cleaned in a short period of time without being restained and without the necessity for extra movement of the carriage.

It is therefore a second object of the present invention to provide an ink jet recording apparatus which requires a reduced cleaning time and is arranged such that the cleaning blade can maintain its cleaning effect over an extended period of time.

BRIEF DESCRIPTION OF THE DRAWINGS

FIG. 4 (*b*) is a diagram illustrating how the wall portion of the cleaning blade comes in elastic contact with an ink absorbing material;

FIG. 8 (*b*) is showing a bottom view of the embodiment of the wall portion of the cleaning blade;

FIG. 9 (*b*) is showing a bottom view of the embodiment of the wall portion of the cleaning blade.

DETAILED DESCRIPTION OF THE PREFEREED EMBODIMENTS

Figure 1:
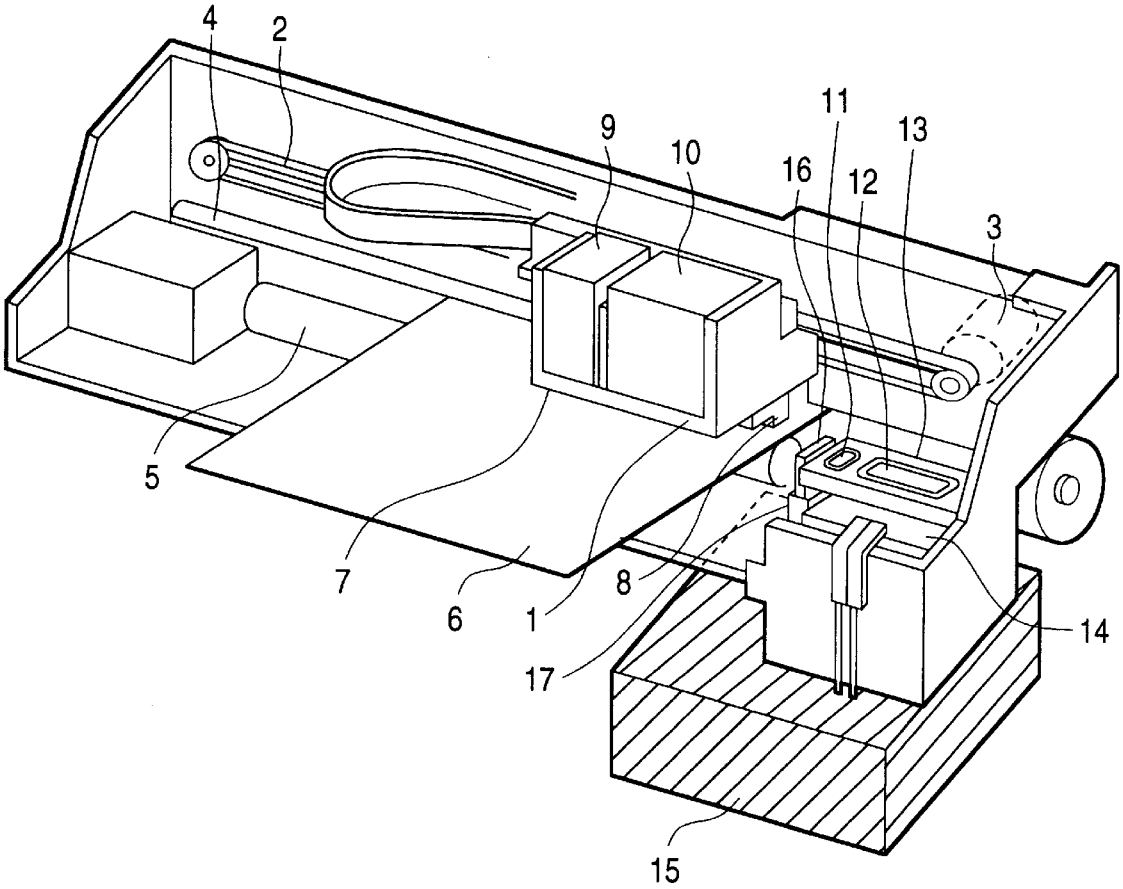
FIG. 1 is a perspective view an embodiment of the ink jet recording apparatus according to the present invention.

FIG. 1 illustrates an embodiment of the ink jet recording apparatus according to the present invention. A carriage 1 is connected to a motor 3 via a timing belt 2 and is arranged to be able to move back and forth in the direction along the axis of a platen under the guidance of a guide member 4. The carriage 1 includes a recording head 7 for expelling black ink droplets and a recording head 8 for expelling color ink droplets mounted on the side thereof opposed to a recording paper 6 and ink cartridges 9 and 10 for supplying inks into the recording head 7 and the recording head 8, respectively, mounted removably on the upper surface thereof.

Provided in the non-printing zone is a capping device 13 comprising cap members 11, 12 for sealing the nozzle opening in the recording heads 7, 8 which serves not only as a capping means for preventing the drying of the nozzle opening during the suspension of printing operation but also as an ink receiver during flushing operation and a suction means of acting negative pressure from a suction pump unit 14 on the recording heads 7, 8 to force the ink to be discharged therefrom.

Provided on the bottom of the pump unit 14 is a waste ink absorption pad 15 made of a porous material having excellent ink receptivity and retention such as felt housed in a container not shown. Provided integrally with or separately of the waste ink absorption pad 15 is a contact piece 18 (see FIG. 2) which comes in contact with the side wall or bottom surface of a supporting member 17 supporting the blade 16 when a cleaning blade 16 described later is on standby.

Figure 2:
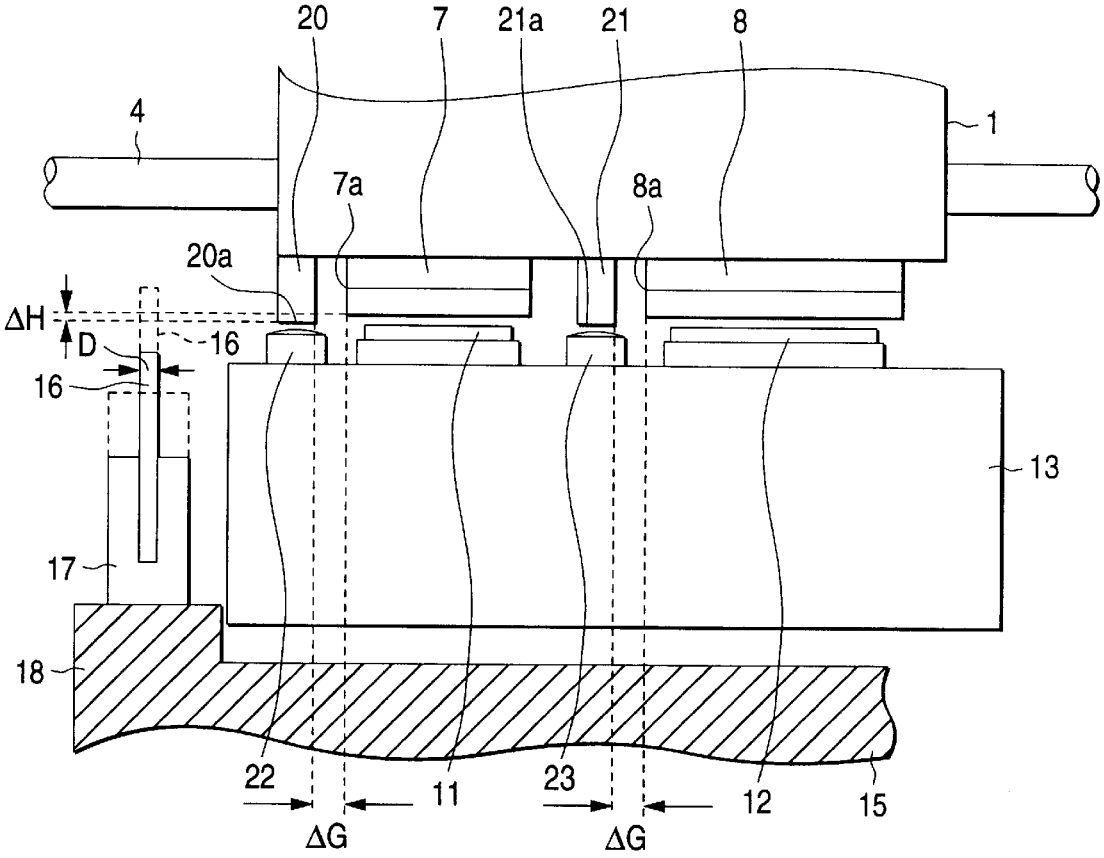
FIG. 2 is an enlarged view illustrating a carriage in a position opposed to a capping device while cleaning operation is not effected.

The cleaning blade 16 is provided in the vicinity of the capping device 13 and in the non-printing zone. As shown in FIG. 2, during a cleaning operation, the cleaning blade 16 is in a position such that the tip thereof would protrude somewhat beyond the lower surface of the nozzle plate of the recording heads 7, 8 towards the ink cartridge to press itself against the nozzle plate and undergo elastic deformation (shown by the broken line). While a cleaning operation is not effected, the cleaning blade 16 is on standby in a position such that the tip thereof doesn't come in contact with the nozzle plate of the recording heads 7, 8 and the supporting member 17 comes in contact with the contact piece 18 of the ink absorption pad 15 (shown by the solid line). The supporting member 17 has been subjected to ink-receptive treatment stronger than the cleaning blade 16 but weaker than the ink absorption pad.

Figure 3:
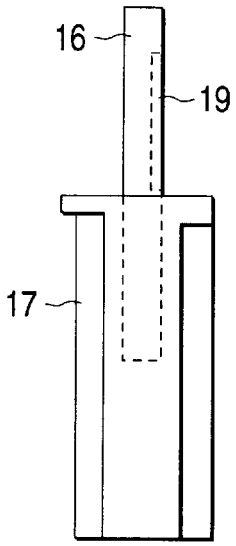
FIGS. 3 (*a*) and (*b*) are a side view and a plan view illustrating an embodiment of the cleaning blade according to the present invention, respectively.
Figure 3:
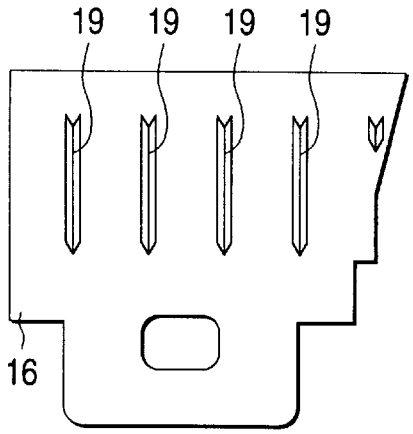

FIG. 3 illustrates an embodiment of the foregoing blade 16. Formed on the surface of the blade 16 which comes in contact with the recording head are a plurality of grooves 19, 19, 19 . . . having a width small enough to exhibit a capillary force that can retain an ink but great enough to perform cleaning without hindrance, extending from the tip towards the supporting member 17.

On the other hand, provided on the recording heads 7, 8 on the side thereof at which cleaning operation begins are wall portions 20, 21, respectively, apart from the side surface 7*a*, 8*a* of the recording heads 7, 8 at a distance ΔG such that no capillary force is produced therebetween, e.g., not less than 1 mm, preferably not less than the thickness D of the cleaning blade 16, more preferably not less than twice the thickness of the blade 16, as shown in FIG. 2. The tips 20*a*, 21*a* of the wall portions 20, 21 are level with the nozzle plate of the recording heads 7, 8 or protrude beyond the nozzle plate of the recording heads 7, 8 somewhat (ΔH) towards the recording paper (downward as viewed in the drawing).

Figure 4:
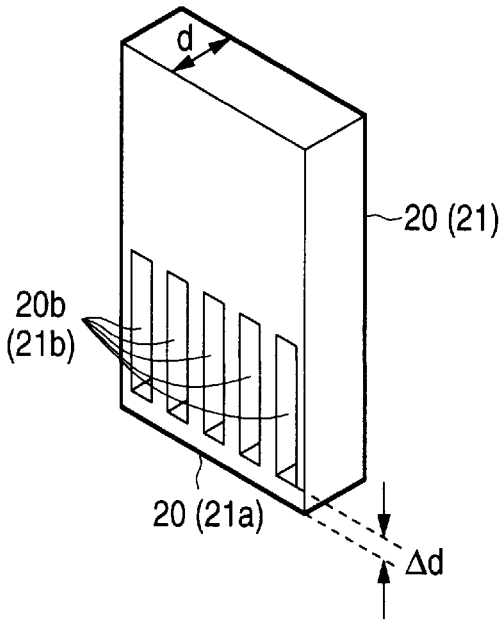
FIG. 4 (*a*) is a perspective view illustrating an embodiment of the wall portion of the cleaning blade.
Figure 4:
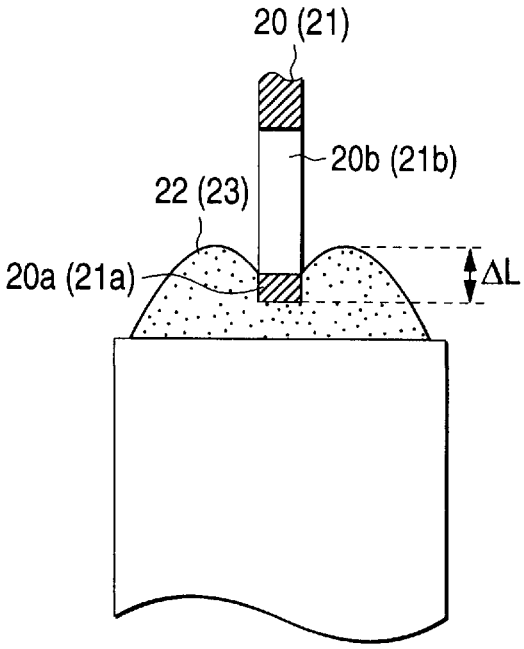

Formed in the wall portions 20, 21 on the surface thereof which comes in contact with the blade 16 are grooves or long holes 20*b* (21*b*) sealed by tips 20*a*, 21*a* as shown in FIG. 4 (*a*) . The tips 20*a*, 21*b* of the wall portions 20, 21 are arranged such that the thickness d thereof is smaller than the indentation ΔL developed when they are elastically pressed against ink-absorbing materials 22, 23 described later as shown in FIG. 4 (*b*). Provided on the capping device 13 are ink-absorbing materials 22, 23 with which at least the tips 20*a*, 21*a* of the wall portions 20, 21 come in contact during the capping of the recording heads 7, 8 in such an arrangement that the capping of the recording heads 7, 8 cannot be impeded.

In the present embodiment, when any of the recording heads 7, 8 shows malprinting, a cleaning switch is depressed to order cleaning. The blade 16 is then allowed to move such that the tip thereof protrudes beyond the nozzle plate of the recording heads 7, 8 towards the ink cartridge (upward as viewed in the drawing) and resides in a position suitable for cleaning.

Subsequently, when the carriage 1 moves in the direction indicated by the arrow A as viewed in the drawing, the tip region of the blade 16 comes in contact with the nozzle plate of the recording head 7 to undergo elastic deformation (see FIG. 5 (I)) during which ink dregs and paper dust attached to the surface of the nozzle plate are wiped off with the ink. The ink K wiped off the recording head 7 moves downward by the capillary force produced in the grooves 19 formed on the surface of the blade 16 (see FIG. 5 (II)).

Figure 5I:
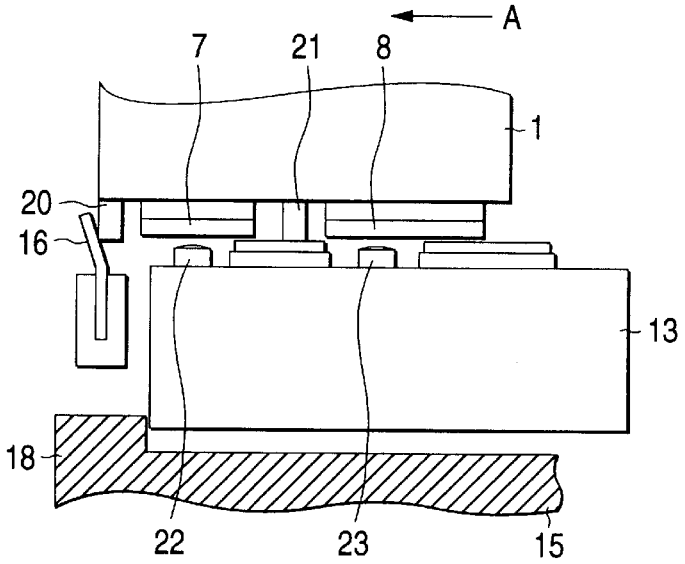
FIGS. 5 (I) to (III) illustrate the former half of the process of cleaning operation performed by the foregoing cleaning device.
Figure 5:
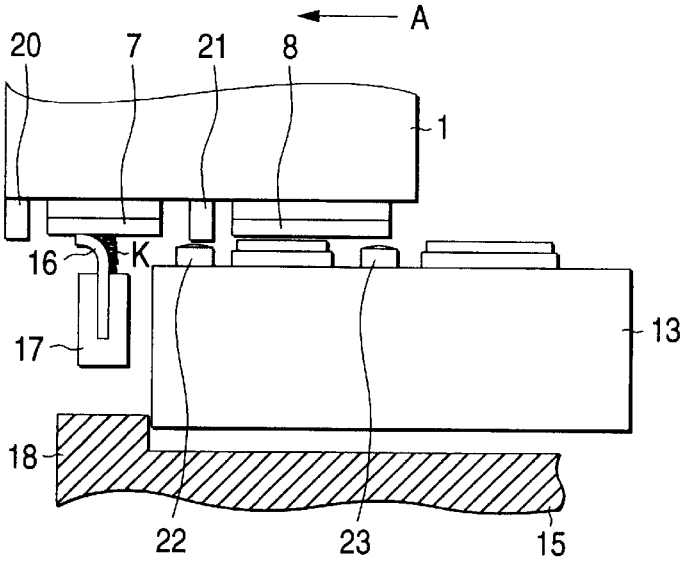
Figure 5:
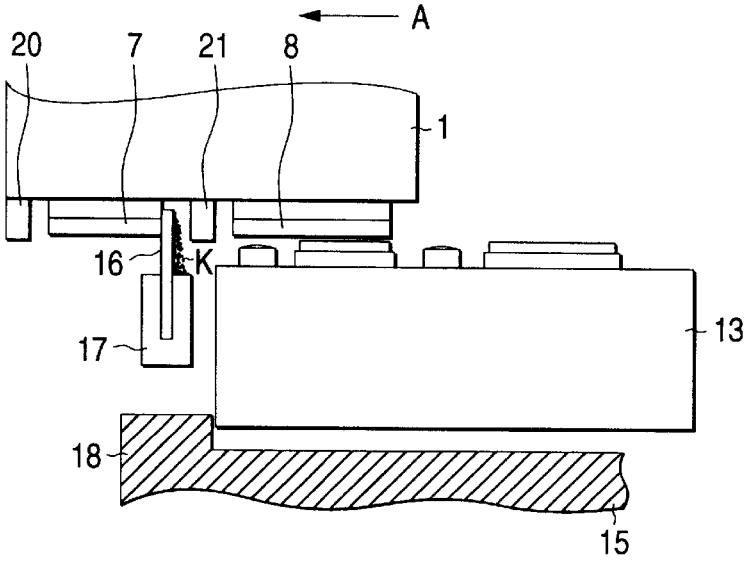

When the carriage 1 further moves until the recording head 7 passes by the blade 16, the blade 16 is released from the elastic pressure by the nozzle plate to suddenly return to the original position by elastic force (see FIG. 5 (III). The ink K wiped off the nozzle plate is then given an inertia. However, since the majority of the ink has moved towards the supporting member 17 of the blade 16, the inertia force received is merely weak. Further, since the ink is retained on the blade 16 by the capillary force produced by the grooves 19, it cannot fly. Thus, the production of ink spray can be inhibited.

Further, even if the ink wiped off the nozzle plate flies by inertia, it is shielded by the side wall 21 of the other recording head 8, preventing the stain on the recording head 8 with the ink.

When the carriage 1 moves even further, the blade 16 comes in contact with the wall portion 21 provided on the side of the recording head 8 so that the ink left on the blade 16 is scratched off by the wall portion 21 before cleaning of the nozzle plate of the recording head 8 in the same manner as for the recording head 7.

When cleaning of the recording head 8 is terminated, the blade 16 is released from the elastic contact with the recording head 8 to spray droplets of ink K. However, since there are no recording heads in the flying direction, the ink droplets have no effects on the printing quality.

When cleaning operation is thus terminated, the blade 16 is shunted to the original position. The carriage 1 then moves in the direction indicated by the arrow B in the drawing to the home position (see FIG. 6 (I)). When the recording heads 7, 8 then reach the capping position, the capping device 13 is moved towards the carriage 1 in linkage with the movement of the carriage 1 (upward as viewed in the drawing) to seal the recording heads 7, 8 with the capping members 11, 12.

In this procedure, the tips 20*a*, 21*a* of the wall portions 20, 21 are elastically pressed against the ink-absorbing materials 22, 23 provided on the surface of the capping device 13. In this manner, as shown in FIG. 4 (*b*), the periphery of the indentation point on the ink-absorbing materials 22, 23 is positioned closer to the fine holes 20*b*, 21*b* than to the tips 20*a*, 21*a* of the wall portion 20, 21 to come in contact with the fine holes 20*b*, 21*b* so that the ink retained in the fine holes 20*b*, 21*b* are absorbed by the ink-absorbing materials 22, 23.

Figure 6I:
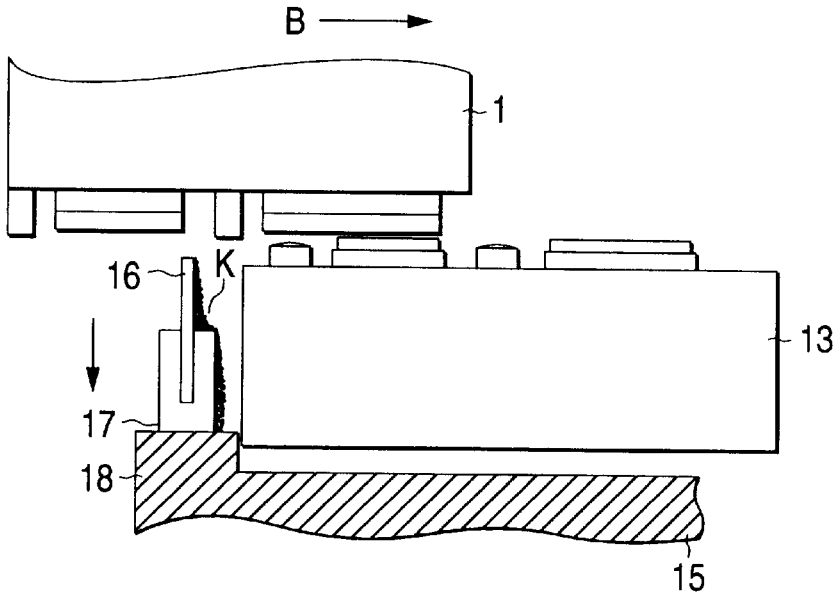
FIGS. 6 (I) and (II) illustrate the operation after the termination leaning operation.
Figure 6:
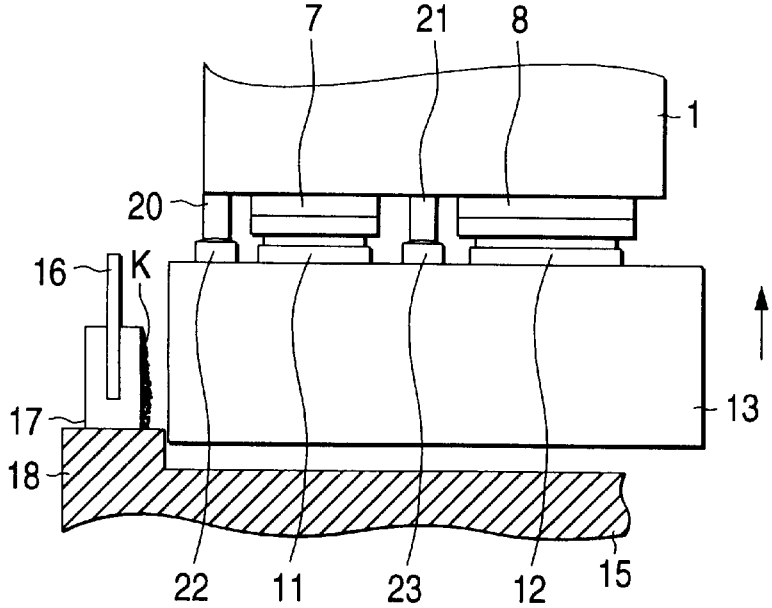

Further, when the supporting member 17 of the cleaning blade 16 comes in contact with the contact piece 18 of the ink absorption pad 15, the ink which has been scratched off the cleaning blade 16 and then flown along the supporting member 17 is then absorbed by an ink absorption pad 15 having a greater capillary force (see FIG. 6 (II)).

Figure 7:
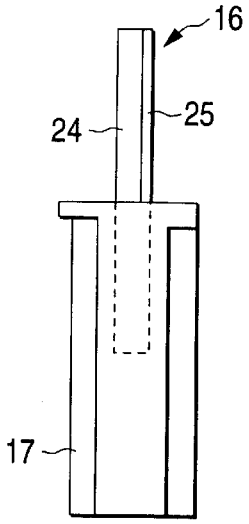
FIGS. 7 (*a*) and (*b*) each illustrate in side elevation another embodiment of the cleaning blade.
Figure 7:
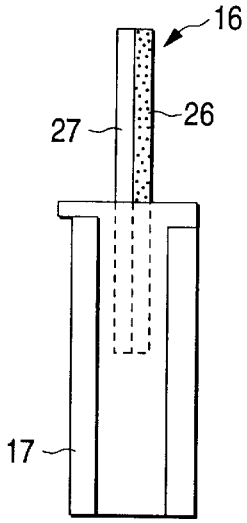

In the foregoing embodiment, slender grooves 19 are formed extending vertically so that the ink can not only move towards the supporting member but also be retained on the blade 16. Alternatively, as shown in FIG. 7 (*a*), an elastic plate material 24 such as rubber may be coated on the surface thereof which comes in contact with the nozzle plate with, as an ink-receptive treatment, a mixture of one or more selected from the group consisting of diethylene glycol, polyethylene glycol, polypropylene glycol, ethylene glycol, propylene glycol, butylene glycol, triethylene glycol, 1,2,6-hexanetriol, thioglycol, hexylene glycol, glycerin, trimethylolethane, trimethylolpropane, urea, 2-pyrrolidone, N-methyl-2-pyrrolidone and 1,3-dimethyl-2-imidazolidine, various surface active agents such as anionic surface active agent, cationic surface active agent and amphoteric surface active agent, and one or more materials selected from the group consisting of alcohols such as methanol, ethanol and isopropyl alcohol, lower alkylethers of polyvalent alcohol such as ethylene glycol monomethyl ether, diethylene glycol monoethyl ether, diethylene glycol monobutyl ether, triethylene glycol monobutyl ether, propylene glycol monobutyl ether and dipropylene glycol monobutyl ether, and acetylene glycols to form a layer 25 thereon. The layer 25 thus formed can exert similar effects.

Alternatively, as shown in FIG. 7 (*b*), a layer 26 which comes in contact with the nozzle plate may be formed by a porous material, and a backing material 27 such as rubber which gives an elasticity such that the blade 16 can come in elastic contact with the nozzle plate of the recording head may be laminated on the layer 26. In this arrangement, the ink on the nozzle plate can be not only moved by the capillary force produced by the layer 26 made of a porous material towards the supporting member 17 of the blade 16 but also retained by the capillary force produced by the layer 26 made of a porous material strong enough to overcome the inertia force.

Figure 8:
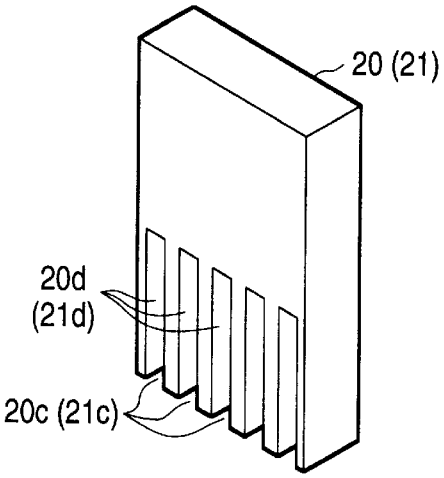
FIG. 8 (*a*) is showing a perspective view of another embodiment of the wall portion of the cleaning blade.
Figure 9:
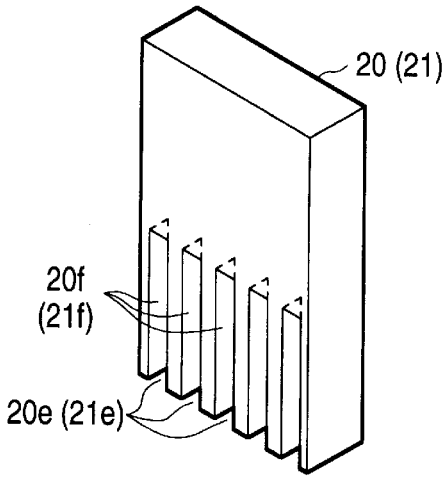
FIG. 9 (*a*) is showing a perspective view of another embodiment of the wall portion of the cleaning blade.
Figure 8:
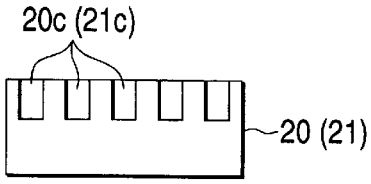
Figure 9:
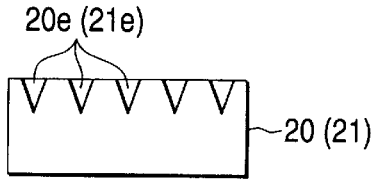

On the other hand, as shown in FIG. 8, the wall portions 20, 21 may have depressions 20*d* (21*d*) having openings 20*c* (21*c*) and a rectangular section formed therein at the end thereof on the surface thereof which comes in contact with the ink-absorbing material 22, 23. Alternatively, as shown in FIGS. 9 (*a*) and (*b*), the wall portions 20, 21 may have depressions 20*f* (21*f*) having openings 20*e* (21*e*) and a triangular section at the end thereof.

In accordance with these embodiments, the ink can be retained by the capillary force of the depressions 20*d* (21*d*) and 20*f* (21*f*). On the other hand, when the wall portions 20, 21 come in contact with the ink-absorbing materials 22, 23, the ink can be easily moved from the tip openings 20*c* (21*c*) and 20*e* (21*e*) to the ink-absorbing materials 22, 23 by the action of the ink-absorbing materials 22, 23 having a stronger capillary force than the depressions 20*d* (21*d*) and 20*f* (21*f*).

The foregoing embodiments have been described with reference to a recording apparatus having an ink cartridge mounted on a carriage. However, it is obvious to those skilled in the art that the present invention can be applied to a recording apparatus having an ink cartridge provided outside the carriage and arranged such that an ink is supplied into the recording head through an ink supply tube.

What is claimed is:

1. An ink jet recording apparatus comprising:

a recording head which jets ink droplets from an opening in a nozzle plate in response to printing signals;

a carriage having said recording head mounted thereon and which performs scanning movement relative to a recording medium, and a cleaning blade which comes in elastic contact with said nozzle plate, said cleaning blade having been subjected to ink-receptive treatment on at least a surface thereof which comes in contact with said nozzle plate, wherein said ink-receptive treatment is provided as a layer of an ink-receptive material that is thinner than said cleaning blade, and said ink-receptive treatment is immovably fixed to said cleaning blade.

2. The ink jet recording apparatus according to claim 1, wherein said ink-receptive material is a mixture of:

one or more materials selected from the group consisting of diethylene glycol, polyethylene glycol, polypropylene glycol, ethylene glycol, propylene glycol, butylene glycol, triethylene glycol, 1,2,6-hexanetriol, thioglycol, hexylene glycol, glycerin, trimethylolethane, trimethylolpropane, urea, 2-pyrrolidone, N-methyl-2-pyrrolidone and 1,3-dimethyl-2-imidazolidine;

at least one surface active agent; and one or more materials selected from the group consisting of alcohol, methanol, ethanol, isopropyl alcohol, lower alkylethers of polyvalent alcohol, ethylene glycol monomethyl ether, diethylene glycol monoethyl ether, diethylene glycol monobutyl ether, triethylene glycol monobutyl ether, propylene glycol monobutyl ether and dipropylene glycol monobutyl ether, and acetylene glycol.

3. The ink jet recording apparatus according to claim 2, wherein said at least one surface active agent is selected from the group consisting of anionic surface active agent, cationic surface active agent and amphoteric surface active agent.

4. An ink jet recording apparatus comprising:

a recording head which jets ink droplets from an opening in a nozzle plate in response to printing signals;

a carriage having said recording head mounted thereon and which performs scanning movement relative to a recording medium, and a cleaning blade which comes in elastic contact with said nozzle plate, said cleaning blade having been subjected to ink-receptive treatment on at least a surface thereof which comes in contact with said nozzle plate, wherein a supporting member holds said cleaning blade and comes in contact with an ink absorption pad in a waste ink tank or an ink-absorbing member extending therefrom at least during the non-cleaning period, and wherein said supporting member of said cleaning blade includes a layer on the surface thereof which has been subjected to an ink-receptive treatment such that the supporting member has a capillary force stronger than that of said cleaning blade but weaker than that of said ink absorption pad.

5. An ink jet recording apparatus comprising a recording head which jets ink droplets from an opening in a nozzle plate in response to printing signals, a carriage having said recording head mounted thereon which performs scanning movement relative to a recording medium, and a cleaning blade which comes in elastic contact with said nozzle plate, characterized in that a wall portion is formed adjacent to said recording head along the direction of scanning movement of said recording head in the vicinity of said recording head at a predetermined gap therefrom on the cleaning initiation side of the recording head and an ink-absorbing material is provided confronted with and in contact with a tip of said wall portion during capping of said recording head with a capping means.

6. The ink jet recording apparatus according to claim 5, wherein the gap between said wall portion and said recording head is great enough to provide the ink with no capillary force.

7. The ink jet recording apparatus according to claim 5, wherein said gap is not less than the thickness of said cleaning blade.

8. The ink jet recording apparatus according to claim 5, wherein the tip of said wall portion protrudes beyond said nozzle plate towards said recording medium.

9. The ink jet recording apparatus according to claim 5, wherein said wall portion has grooves or fine holes for retaining an ink formed on the surface thereof with which said blade comes in contact.

10. The ink jet recording apparatus according to claim 5, wherein said wall portion is formed integrally with said carriage.

11. An ink jet recording apparatus comprising:

a plurality of recording heads which jet ink droplets from openings in nozzle plates in response to printing signals;

a carriage having said recording heads mounted thereon and which performs scanning movement relative to a recording medium;

a cleaning blade which comes in elastic contact with said nozzle plates;

wall portions formed adjacent to said recording heads along the direction of scanning movement of said recording heads in the vicinity of said recording heads with a predetermined gap therefrom on the cleaning initiation side of said recording heads; and an ink-absorbing material provided confronted with and in contact with tips of said wall portions during capping of said recording heads with a capping means.

12. The ink jet recording apparatus according to claim 11, wherein each gap between one of said wall portions and one of said recording heads is great enough to provide the ink with no capillary force.

13. The ink jet recording apparatus according to claim 11, wherein said gap is not less than the thickness of said cleaning blade.

14. The ink jet recording apparatus according to claim 11, wherein the tips of said wall portions protrude beyond said nozzle plates towards said recording medium.

15. The ink jet recording apparatus according to claim 11, wherein said wall portions have grooves or fine holes for retaining an ink formed on the surface thereof with which said blade comes in contact.

16. The ink jet recording apparatus according to claim 11, wherein said wall portions are formed integrally with said carriage.

* * * * *